United States Patent [19]

Montooth

[11] 4,300,252

[45] Nov. 17, 1981

[54] WHEEL SUPPORT FOR BOW END OF A BOAT

[75] Inventor: George A. Montooth, Long Beach, Calif.

[73] Assignee: Recreation Industries Company, Portland, Oreg.

[21] Appl. No.: 970,754

[22] Filed: Dec. 18, 1978

[51] Int. Cl.[3] ..... B63C 13/00

[52] U.S. Cl. ..... 9/1.2; 188/4 R

[58] Field of Search ..... 9/1.1, 1.2; 280/414 R, 280/414 A, 491 R, 486–490, 498, 499; 188/4 R, 5

[56] References Cited

U.S. PATENT DOCUMENTS

| | | | |
|---|---|---|---|
| 2,344,148 | 3/1944 | Jackson | 188/4 R |
| 3,133,293 | 5/1964 | Brush | 9/1.2 |
| 3,738,684 | 6/1973 | Lusk | 9/1.2 |

FOREIGN PATENT DOCUMENTS

| | | | |
|---|---|---|---|
| 407957 | 1/1910 | France | 188/4 R |
| 296533 | 9/1928 | United Kingdom | 188/4 R |

*Primary Examiner*—Trygve M. Blix
*Assistant Examiner*—Jesus D. Sotelo
*Attorney, Agent, or Firm*—Eugene M. Eckelman

[57] ABSTRACT

A wheeled body member is arranged to be attained to the bow of a boat and such body member has two positions one of which holds the wheeled support in a raised position allowing normal operation of the boat and the other of which holds the wheeled support in a lowered ground engaging position. The body member has a hitch so that it can be releasably secured to a towing vehicle. A brake mechanism is provided to prevent rearward rotation of the wheel when desired. In one embodiment, mounting arms are employed having releasable ball-type connectors which permit them to be readily removed from the boat. This embodiment has adjustments adapting it to different sizes and shapes of boats.

4 Claims, 12 Drawing Figures

WHEEL SUPPORT FOR BOW END OF A BOAT

BACKGROUND OF THE INVENTION

This invention relates to new and useful improvements in wheel supports for boats and particularly pertains to a wheel support for the bow end.

It has heretofore been customary to mount various types of wheels on boats, particularly toward or at the stern so that the boat can be pulled or otherwise manipulated in landing or storage areas. In launching or landing a boat, it is difficult for the operator to handle the boat, even with wheels at the stern, particularly if the boat is heavy or bulky.

SUMMARY OF THE INVENTION

According to the present invention and forming a primary objective thereof, a wheel support is provided which is arranged to be mounted on the bow end of a boat to provide more effective and convenient handling of the boat both on land and in launching and landing the boat.

To carry out objectives of the invention, a body member is provided which is arranged to be secured to the bow of a boat and which has wheeled support movable either to a raised position allowing normal operation of the boat or to a lowered position providing wheeled support for the boat. The body member has hitch means on it so that it can be releasably secured to a towing vehicle if desired. The wheel is associated with a brake mechanism capable of providing a braking action in rearward movements of the boat. In one embodiment of the invention, a pair of mounting arms are employed which extend rearwardly and which are arranged for attachment to opposite sides of a boat. In addition, this embodiment has a support link with one end connected to the body member and the other end arranged to be releasably connected to bracket means on the boat in a manner such that the wheeled support can be held either in its raised or lowered position. These mounting arms and support link are adjustable in length to accommodate different sizes and shapes of boats and in addition are readily removable from the boat to remove the wheeled support between uses.

The invention will be better understood and additional objects and advantages will become apparent from the following description taken in connection with the accompanying drawings.

DETAILED DESCRIPTION OF A PREFERRED EMBODIMENT

Figures 1, 2, 3:
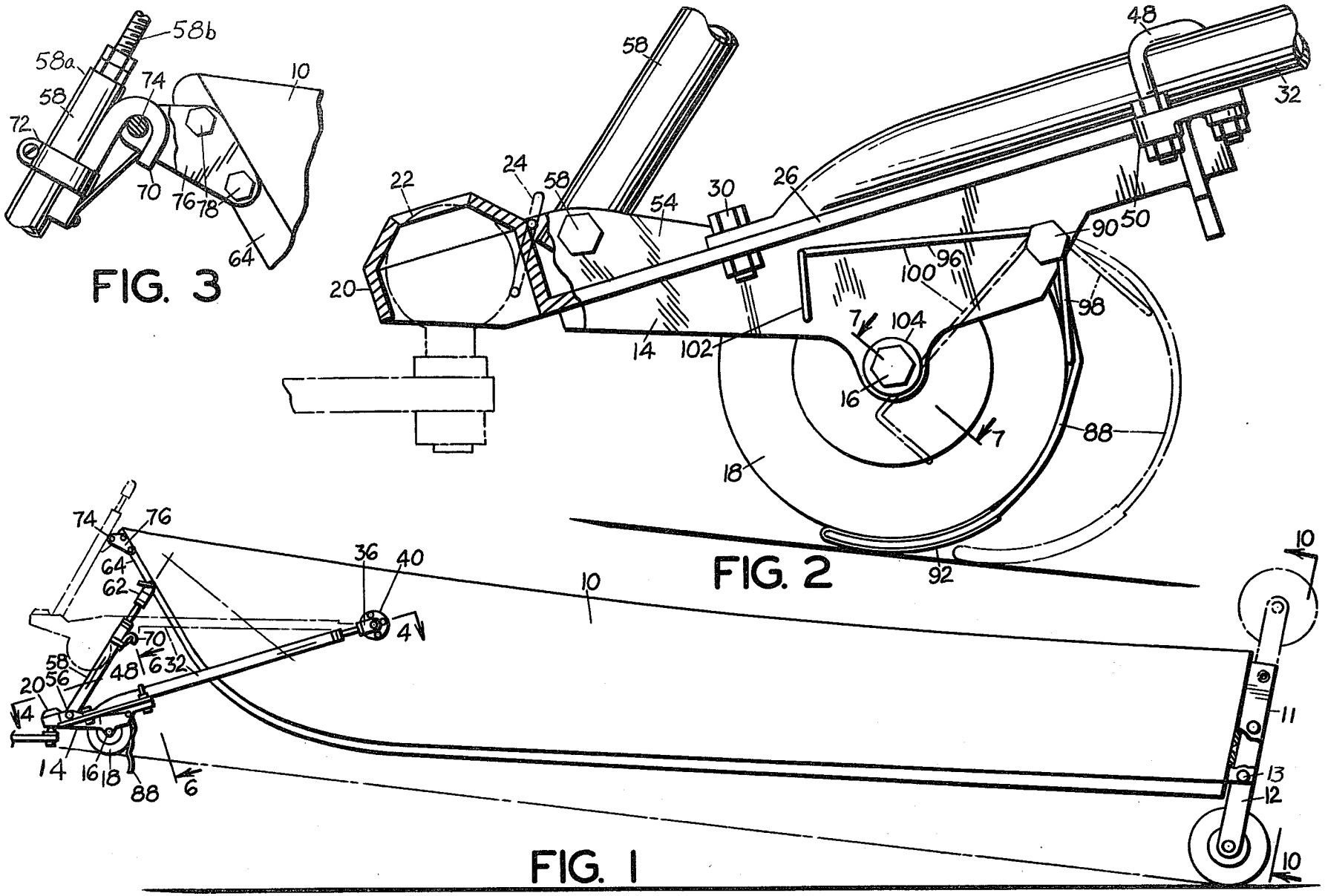
FIG. 1 is a side elevational view of a bow wheel support of the invention as applied to a boat.
FIG. 2 is a fragmentary side elevational view, in enlarged scale and partly broken away, of the wheel support of FIG. 1.
FIG. 3 is an enlarged fragmentary elevational view, partly broken away, of bracket means for attaching a portion of the wheel support of FIG. 1 to a boat.
Figure 10:
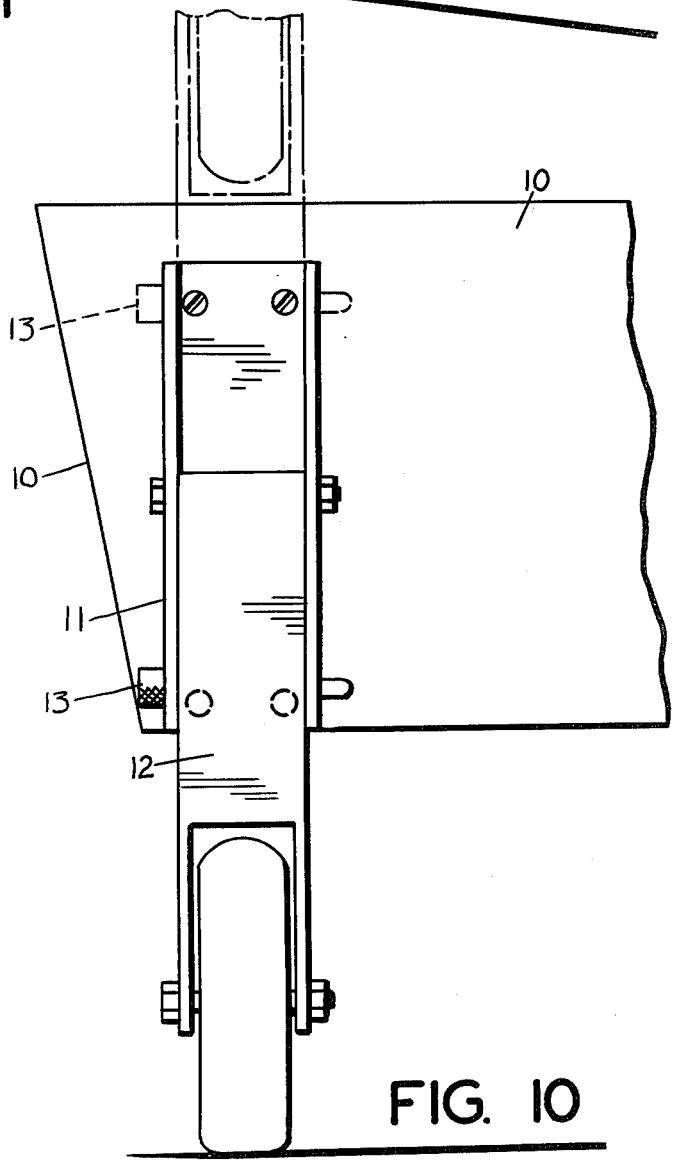
FIG. 10 is an enlarged rear elevational view of a stern wheel assembly for boats with which the present invention may be used, this view being taken on the line 10—10 of FIG. 1.

With particular reference first to FIG. 1, a first form of the present invention is shown which is adapted for combination with the bow of a boat 10 of a size and type that generally is manipulated by one or more persons in moving it around for purposes of launching, landing, storage, or otherwise. It will generally be used in combination with a stern wheel assembly 11, also seen in FIG. 10, having a wheel supporting arm 12 pivotal between a lowered use position and a raised non-use position as seen in full and broken lines, respectively, in FIG. 1. The arm 12 is held in these positions by a latch pin 13 movable between two latch positions as shown in full and broken lines in FIG. 1.

The bow wheel of the invention comprises a main body member 14, FIGS. 1, 2, 4 and 6, having an axle 16 for a ground engaging wheel 18. The front end of body member 14 has a hitch-type socket 20 arranged to receive a conventional trailer hitch ball 22, FIG. 2, in the event it is desired that the boat on which the present wheel supports is mounted is to be towed by a towing vehicle. A removable lock pin 24 is associated with the socket 20 for releasable lock engagement with the trailer hitch ball 22.

Body member 14 has oppositely extending side flanges 26 provided with a plurality of longitudinally spaced apertures 28. These apertures receive bolts 30 which secure one end of a pair of support arms 32 to the body member 14. The opposite ends of the arms 32 comprise sockets 36 arranged to receive hitch-type balls 38 integral with base plates 40 arranged to be attached to the sides of a boat by bolts 42, an inner backing plate 44 being used if necessary such as when the apparatus is installed on thin shelled boats such as aluminum boats. Sockets 36 have lock pins 46 associated therewith, also seen in FIG. 5, which securely hold these ends of the arms on the boat but allow ready detachment if desired. Arms 32 consist of a main tubular member **32*a*, FIG. 4, and a threaded extension 32*b*, thus providing length adjustment adapting the apparatus for mounting on different shapes and sizes of boats. Arms 32 pass through flattened U-bolts 48 secured on lateral extensions 50 of the body member 14. For the purpose of providing an integral and rigid connection to the boat, it is preferred that the arms 32 when mounted on the boat bear firmly up against the outer portion of the U-bolts 48. Such a bearing adjustment is accomplished by attachment of the lower end of the arms 32 in selected apertures 28** as determined by the angular disposition of the arms to fit the boat.

Figure 4:
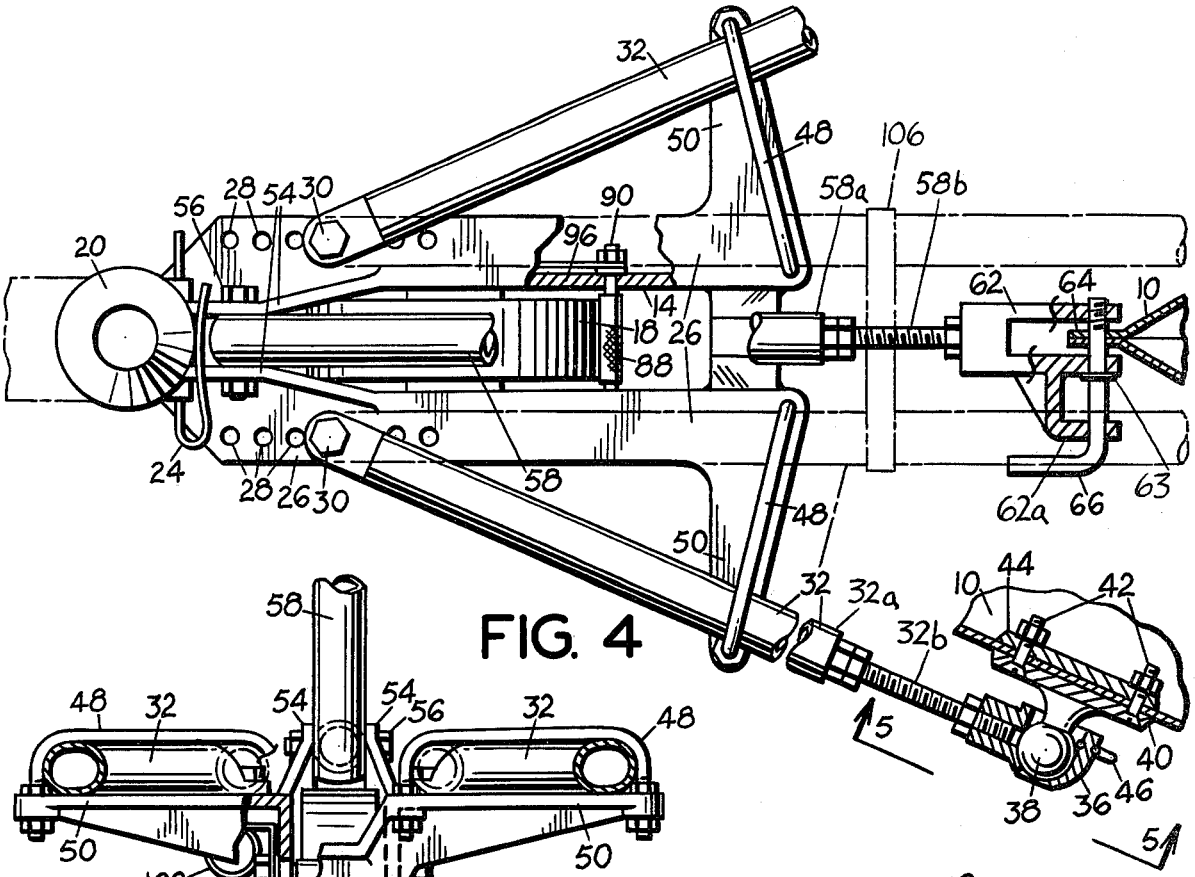
FIG. 4 is an enlarged fragmentary plan view, partly broken away, taken on the offset line 4—4 of FIG. 1.
Figure 6:
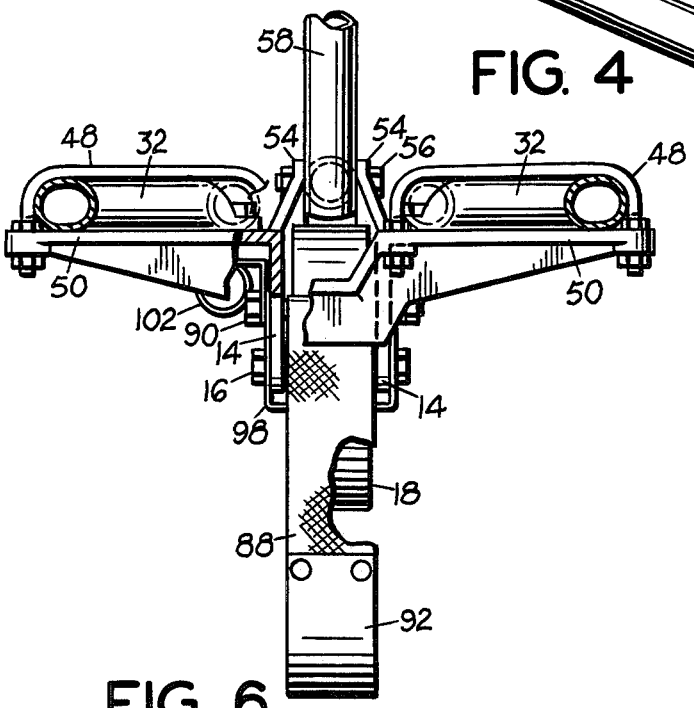
FIG. 6 is an enlarged fragmentary rear elevational view, partly in section, taken on the line 6—6 of FIG. 1.
Figure 5:
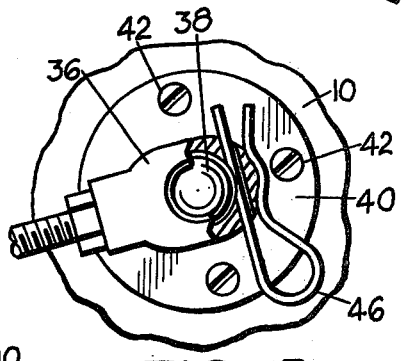
FIG. 5 is an enlarged fragmentary elevational view, partly broken away, showing releasable attaching means for support arms, this view being taken on the line 5—5 of FIG. 4.
Figure 8:
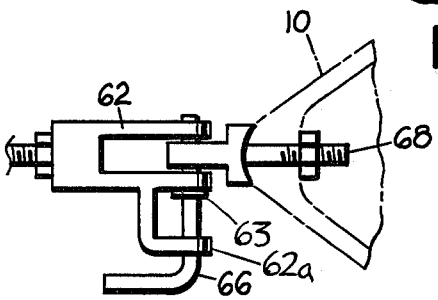
FIG. 8 is a fragmentary plan view showing an alternative form of bracket means for mounting a support link of the present wheel support on a boat.

The forward end of body member 14 has upstanding ears 54 providing a pivot attachment, as by means of a bolt 56, for one end of a support link 58 terminating at its upper end in a clevis-type connector 62, FIGS. 1 and 4, arranged to straddle and be connected to a forwardly extending ridge 64 of the boat. For connecting the member 62 to the boat, an aperture is cut in this ridge to receive a lock pin 66 of the connector 62. In the event that the boat 10 does not have a ridge 64, such as may be the case with wood-type boats, an eye bolt 68, FIG. 8, can be securely attached to the front beam of the boat. The lock pin 66 in this case engages such eye-bolt. Connector 62 has an auxiliary arm 62*a* through which the lock pin 66 extends, and a snap ring 63 is secured on the lock pin in a selected position between the connector and its arm 62*a* such that it allows proper functioning of the lock pin for releasably securing the connector to a boat but at the same time it prevents the said lock pin from being completely detached from the connector and lost.

Support link 58 consists of a main tubular member 58*a* and a threaded extension 58*b*, FIGS. 1 and 3, to provide length adjustment as necessary to custom fit a variety of boats.

Figure 9:
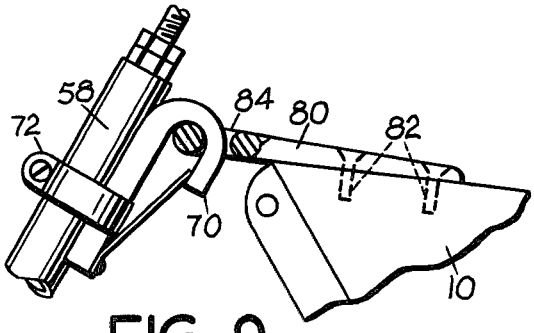
FIG. 9 is an elevational view, partly broken away, showing another form of mounting bracket which may be used in attaching the present wheel support to a particular-type of boat.
Figure 7:
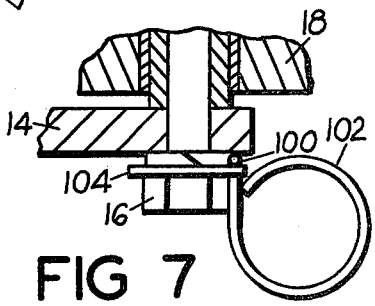
FIG. 7 is a fragmentary sectional view of a detail of brake control means for the wheel, this view being taken on the line 7—7 of FIG. 2.

With reference to FIGS. 1 and 3, support link 58 has a snap hook 70 secured integrally thereto at a point below the upper end, such securement being accomplished by clamp means 72. This snap hook is arranged for releasable engagement with the cross pin 74 of a bracket 76 secured to the bow of the boat. Bracket 76 may be secured by bolts 78 to the forwardly extending ridge 64 of the boat or if it is not possible to mount such bracket on the boat, a plate 80, FIG. 9, can be secured with screws 82 to a top portion of the boat. This plate has a front aperture or eye 84 engaged by the snap hook 70.

Wheel 18 is associated with a brake, FIGS. 1, 2, 4, 6 and 7, designed so that in a controlled function thereof it prevents reverse rotation of the wheel. Such brake comprises a flap 88 supported at its upper end on a cross pin 90 mounted in the body member 14. This pin is located vertically above the rear edge of the wheel 18 so that normally the flap 88 will hang directly down along the rear edge of the wheel. This flap is of a length sufficient such that it can be run onto by the wheel in rearward rolling movement of such wheel. Flap 88 has a metal sleeve 92 on its lower end to provide a wear surface.

Associated with the flap 88 is a clutch or control member 96 formed of spring wire and having a U-shaped or loop portion 98 projecting down from the cross pin 90 adjacent to the surface of the wheel 18 in a released condition of the clutch. Loop 98 extends between the wheel and the flap 88 and the ends thereof are coiled around projecting ends of the cross pin 90, one of the ends 100 of the loop being extended and terminating in a finger loop 102 best seen in FIG. 7. Clutch member 96 has a first position, namely a position shown in full lines in FIG. 2, wherein it allows the flap member 88 to be run onto by rear rolling movement of the wheel 18. In a second position of the clutch 96, in an engaged position shown in broken lines in FIG. 2 and in full lines in FIG. 7, the end 100 thereof is hooked under the shaft 16 behind a washer 104 on such shaft. This latter position of the clutch causes the loop 98 to urge the brake flap 88 outwardly from the wheel to the position shown in broken lines in FIG. 2. In this latter position, the flap is held clear of the wheel so that it will not be engaged by the wheel in rear rolling movement of the wheel.

In the operation of the brake 88, the clutch 96 can be placed in its engaged position, namely, the broken line position of FIG. 2, to allow free rolling movement of the wheel. This holds the flap away from the wheel and the boat can be rolled freely in both directions. When it is desired to use the brake, the clutch 96 is released to its full line position of FIG. 2 whereby the brake flap 88 is capable of falling by gravity to a lowered position. Any rearward movement of the boat will now cause the wheel 18 to run onto flap 88. This applies a braking action to the wheel. The brake is released by forcing the clutch down to its dotted line position of FIG. 2 and then lifting the boat up or rolling it a slight amount to allow the flap to move out from under the wheel under the spring action of the clutch. As an example of use of the brake, the boater can back the boat down a launching ramp and release the clutch when the bow is still out of the water. A slight further rearward movement of the boat will thus apply the brakes and the boater can conveniently board the boat. After he boards the boat, he reaches down and releases the clutch and then by rocking the boat or by shifting his weight to the stern, the brake will release itself and raise up out of the way to allow the boat to fully back into the water. The bow wheel support can be raised to its elevated position if desired after the boat is in the water. It is apparent also that the brake can be used in landing a boat since with the wheel down and the clutch 96 released, the boat can be propelled partly up a ramp and when stopped, the brake will apply itself if the boat starts to roll rearward. In this latter use, the brake can be readied by releasing the clutch while the boat is still in the water and the wheel support is in elevated position.

When not attached to the boat, the apparatus of FIG. 1 can be compacted in that the support link 58 can be laid down against the body member 14 and the arms 32 pivoted inwardly parallel with the body member 14 to the position shown in broken lines in FIG. 4. The arms and support link can be bundled together by strap means 106.

Figure 11:
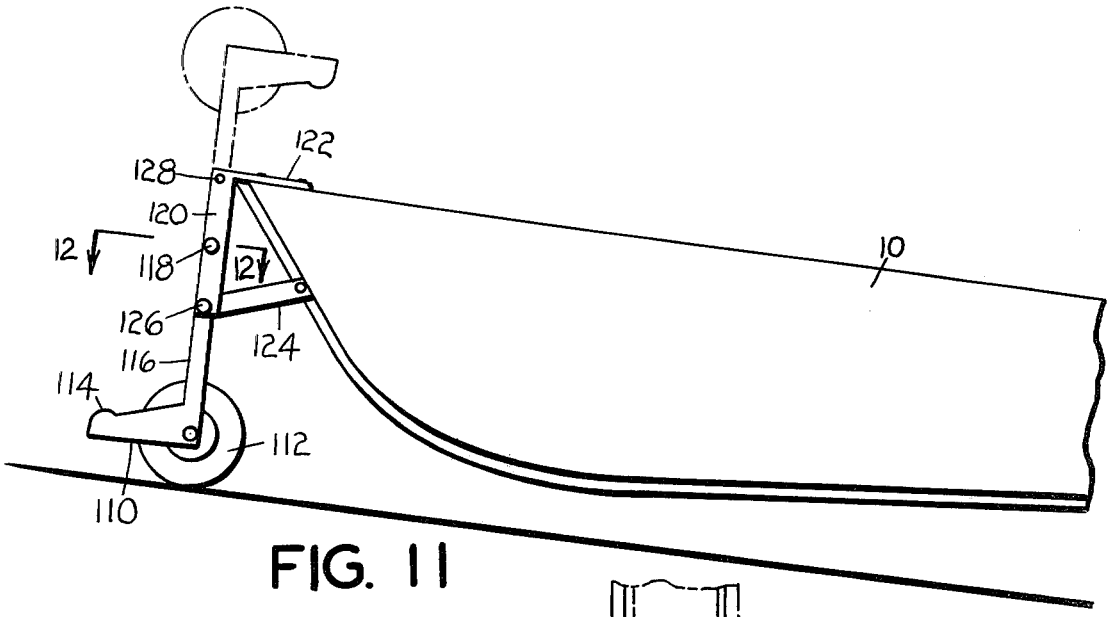
FIG. 11 is a side elevational view similar to FIG. 1 but showing a modified form of the bow wheel support for a boat.
Figure 12:
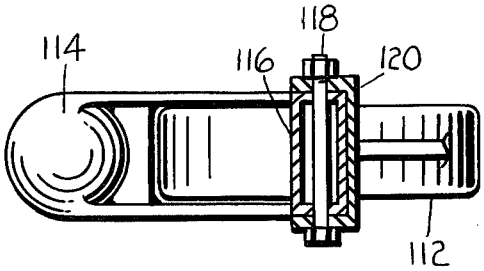
FIG. 12 is an enlarged sectional view taken on the line 12—12 of FIG. 11.

Another embodiment of the invention is shown in FIGS. 11 and 12. This embodiment similarly employs a body member 110 having a supporting wheel 112 thereon and a hitch socket 114. A support link 116 extends integrally from body member 110 and has a pivoted connection 118 at its upper end in a channel-shaped bracket 120 secured to the boat by means of a right angle extension 122 thereof bolted to the top of the boat and brace means 124 secured between a lower portion of said bracket and the front ridge of the boat. The pivot connection 118 allows the wheel support to extend down in a use position, as shown in full lines in FIG. 11, or up in a non-use position as shown in broken lines. A removable latch pin 126 engageable in upper and lower apertures 128 in the bracket 120 and suitable apertures in the link 116 hold the wheel support in these two positions. The structure of FIGS. 11 and 12 can be associated with brake mechanism as in FIG. 1 if desired.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A wheel support assembly for a pointed bow, V-bottom boat comprising (a) a body member having forward and rearward ends and opposite sides, (b) a wheel on said body member, (c) a pair of arms having opposite ends, (d) means connecting one end of said arms to respective sides of said body member, (e) connecting means on the other end of said arms arranged to connect said other end to opposite sides of a boat rearwardly of the bow, (f) abutting means on each side of said body member rearwardly of the connection of said arms to said body member, (g) said arms bearing forcibly outwardly against said abutting means intermediate their ends to cause said other ends of said arms to push inwardly against its side of a boat and provide a laterally rigid draft connection between said body member and a boat, (h) link means intermediate said arms having opposite ends, (i) connecting means on one end of said link means connecting said link means to said body member, (j) and connecting means on the other end of said link means arranged to connect said other end of said link means to an upper point of the bow of a boat.

2. The wheel support assembly of claim 1 wherein said means connecting one end of said arms to respective sides of said body member include a plurality of front to rear spaced holes on each side of said body member for selected attachment to the one end of said arms according to the width of a boat to which said wheel supported assembly is to be attached.

3. The wheel support assembly of claim 1 including length adjustment means for said arms and for said link means.

4. The wheel support assembly of claim 1 wherein said abutting means comprises loop members confining said arms.

* * * * *